US005685431A

United States Patent [19]

Chambers et al.

[11] Patent Number: 5,685,431

[45] Date of Patent: Nov. 11, 1997

[54] PACKAGING SYSTEM FOR CLUTCH SETS

[75] Inventors: Hyrum Chambers, Edmond; Randy James Millikan; Claude Rappaport, both of Oklahoma City, all of Okla.

[73] Assignee: L & S Bearing Co., Oklahoma City, Okla.

[21] Appl. No.: 606,776

[22] Filed: Feb. 27, 1996

[51] Int. Cl.[6] ..... B65D 85/30; B65D 81/02; B65D 59/00

[52] U.S. Cl. ..... 206/521; 53/468; 53/472; 53/474; 206/223; 206/523; 206/588; 206/592

[58] Field of Search ..... 206/223, 234, 206/318, 490, 486, 577, 588, 590, 592, 593, 523; 53/472, 473, 474, 467, 468

[56] References Cited

U.S. PATENT DOCUMENTS

| | | | |
|---|---|---|---|
| 2,531,543 | 11/1950 | Sutphen | 214/10.5 |
| 3,028,003 | 4/1962 | Keder et al. | 206/65 |
| 3,286,834 | 11/1966 | English, Jr. | 206/523 |
| 3,416,648 | 12/1968 | Levi | 206/46 |
| 3,421,679 | 1/1969 | Goldman | 206/523 |
| 3,596,754 | 8/1971 | Peterson, Jr. | 206/14 |
| 3,709,402 | 1/1973 | Templeton et al. | 221/33 |
| 3,741,382 | 6/1973 | Larimer, Sr. | 206/47 R |
| 3,746,242 | 7/1973 | Troth | 229/23 R |
| 3,750,871 | 8/1973 | Cook | 206/46 FC |
| 3,878,941 | 4/1975 | Kelner | 206/419 |
| 3,946,870 | 3/1976 | Gajer et al. | 206/471 |
| 4,162,729 | 7/1979 | Kaiser et al. | 206/592 |
| 4,219,145 | 8/1980 | Jaeschke et al. | 229/8 |
| 4,240,240 | 12/1980 | Cohen | 53/410 |
| 4,270,692 | 6/1981 | Webinger | 229/11 |
| 4,391,371 | 7/1983 | Sieffert | 206/597 |
| 4,392,605 | 7/1983 | Backman | 229/19 |
| 4,640,418 | 2/1987 | Lowry | 206/588 |
| 4,763,789 | 8/1988 | Questel et al. | 206/454 |
| 4,865,197 | 9/1989 | Craig | 206/328 |
| 4,909,389 | 3/1990 | Plessers et al. | 206/451 |
| 4,978,006 | 12/1990 | Juteau | 206/449 |
| 4,978,009 | 12/1990 | Pany | 206/620 |
| 4,986,419 | 1/1991 | Collett et al. | 206/387 |
| 5,040,678 | 8/1991 | Lenmark, Sr. et al. | 206/523 |
| 5,214,904 | 6/1993 | De Point et al. | 53/468 |
| 5,247,747 | 9/1993 | Grey et al. | 53/472 |
| 5,320,223 | 6/1994 | Allen | 206/372 |
| 5,322,181 | 6/1994 | Nelson | 220/461 |
| 5,356,006 | 10/1994 | Alpern et al. | 206/363 |
| 5,360,113 | 11/1994 | Harris | 206/427 |

FOREIGN PATENT DOCUMENTS

| | | | |
|---|---|---|---|
| 1410347 | 8/1965 | France | 206/523 |
| 262251A | 7/1989 | France | B65D 81/02 |
| 1247002 | 9/1971 | United Kingdom | B65D 25/12 |

OTHER PUBLICATIONS

Croft, John E., Universal Package, Technical Notes Publication, pp. 1–2 Jan. 02, 1969.

*Primary Examiner*—Paul T. Sewell
*Assistant Examiner*—Anthony Stashick
*Attorney, Agent, or Firm*—McKinney, Stringer & Webster

[57] ABSTRACT

A packaging system for clutch sets. The system includes a box provided with several packing sheets of compressible foam which can be custom fitted to the clutch set components. The packaging system allows several sizes of clutch sets to be securely packaged in the same size box, and the compressible foam provides a lightweight means for stabilizing the components during shipping or storage. The outside of the box is unmarked except for a label on one side for a bar code or other information. The system includes a sleeve like wrapper with a hole in the side to reveal the label on the side on the box. The outside of the sleeve is imprinted with a brand name and other trade dress. This allows a bearing manufacturer to maintain an inventory of various sizes of pre-packaged clutch sets, along with an inventory of preprinted sleeves. Then, upon receipt of an order from a retail customer, the time necessary to complete the private label packaging of the clutch sets is substantially reduced. Moreover, because of the foam sheets, the boxes can be stored or shipped safely in stacks or on their sides.

28 Claims, 3 Drawing Sheets

PACKAGING SYSTEM FOR CLUTCH SETS

FIELD OF THE INVENTION

The present invention relates to packaging systems for clutch sets.

SUMMARY OF THE INVENTION

The present invention is directed to an assembly comprising a packaged clutch set. The assembly includes a clutch cover having a diaphragm and a body portion extending upwardly and outwardly from the diaphragm to form a cavity. Also included are a clutch disk having an edge and a clutch bearing.

A box is included to package the clutch set. The box is sized to receive the clutch cover, the clutch disk and the bearing. The box has a bottom, a top and four sides, and the top of the box is openable to permit access to the inside of the box.

The combination clutch set and packaging assembly further includes a bottom sheet of foam sized to fit in the bottom of the box and a center sheet of foam sized to fit in the box over the bottom sheet of foam. The center sheet of foam has a central opening sized to receive the diaphragm of the clutch cover, and the diaphragm of the clutch cover is positioned therein. The center sheet of foam also has a corner opening sized to receive the bearing, and the bearing is positioned therein.

Also provided in the assembly is a corner sheet of foam sized to have a portion which covers the bearing in the corner opening of the center sheet of foam and to have a flap sized to fit under the edge of the clutch disk. Thus, the position of the bearing in the corner opening is at least partially secured by the corner sheet of foam while it is held in place by the edge of the clutch disk, which is positioned to nest inside the cavity of the clutch cover. A top sheet of foam is included; it is sized to fit in the box over the bottom, center and corner sheets of foam and the clutch cover, bearing and clutch disk assembled in the box.

In another embodiment, the present invention is directed to a packaging assembly for packaging clutch sets. Each of the clutch sets comprises a clutch disk having an edge, a bearing and a clutch cover, the clutch cover having a diaphragm, a body portion extending upwardly and outwardly from the diaphragm to form a cavity. The packaging assembly is adapted to package clutch sets of a plurality of sizes and to receive both boxed and unboxed bearings.

The packaging assembly comprises a plurality of boxes all of the same size, the size being selected to receive the largest of the plurality of clutch sets. Each of the boxes has a bottom, a top and four sides, and the top of each box is openable to permit access to the inside of the box.

Included in the assembly is a plurality of bottom sheets of foam, each bottom sheet of foam being sized to fit in the bottom of each of the boxes. A plurality of center sheets of foam also is included, and each center sheet of foam is sized to fit in each of the boxes over the bottom sheets of foam.

Each of the center sheets of foam is perforated in a selected pattern for easy removal of a first, second and third piece of foam. The selected pattern includes a first group of perforations defining a plurality of concentric circles generally in the center of the center sheet of foam. Each of the circles of the first group has a diameter about the same as the diameter of the diaphragm of the clutch cover in a different one of the plurality of clutch sets. The selected pattern of perforations further includes a second group positioned generally in a first corner of the center sheet of foam. The second group defines a plurality of concentric circles, and each of the circles of the second group of perforations has a diameter about the same as the external dimension of one of the plurality of unboxed bearings of the clutch sets.

The selected pattern of perforations still further includes a third group of perforations positioned generally in a second corner of the center sheet of foam. The third group defines a plurality of concurrent rectangles, each rectangle sized to receive a different one of the plurality of boxed bearings.

Also included is a plurality of top sheets of foam sized to fit in each of the boxes over the bottom and center sheets of foam, when assembled with the clutch set inside the box.

Further still, the present invention comprises a method for packaging a plurality of clutch sets of different sizes. In accordance with the method, a plurality of clutch sets of different sizes is provided. Each clutch set comprises a clutch disk having an edge, a bearing, and a clutch cover having a diaphragm and a body portion extending upwardly and outwardly from the diaphragm to form a cavity. Some of the clutch sets include boxed bearings, and some of the clutch sets include unboxed bearings A plurality of packaging assemblies are provided. Each packaging assembly comprises a plurality of boxes all of the same size, the size being selected to receive the largest of the plurality of clutch sets. Each of the boxes has a bottom, a top and four sides, and the top of each box is openable to permit access to the inside of the box.

The packaging assembly includes a plurality of bottom sheets of foam, each bottom sheet of foam being sized to fit in the bottom of each of the boxes. A plurality of center sheets of foam is included, each center sheet of foam being sized to fit in each of the boxes over the bottom sheets of foam.

Each of the center sheets of foam is perforated in a selected pattern for easy removal of a first, second and third piece of foam. The selected pattern includes a first group of perforations defining a plurality of concentric circles generally in the center of the center sheet of foam, each of the circles of the first group having a diameter about the same as the diameter of the diaphragm of the clutch cover in a different one of the plurality of clutch sets.

The selected pattern of perforations also includes a second group positioned generally in a first corner of the center sheet of foam, the second group defining a plurality of concentric circles. Each of the circles of the second group of perforations has a diameter about the same as the external dimension of one of the plurality of unboxed bearings of the clutch sets.

Still further, the selected pattern of perforations includes a third group of perforations positioned generally in a second corner of the center sheet of foam. The third group defines a plurality of concurrent rectangles, each rectangle sized to receive a different one of the plurality of boxed bearings.

Still further, the packaging assembly includes a plurality of top sheets of foam. The third sheets are sized to fit in each of the boxes over the bottom and center sheets of foam, when assembled with the clutch set inside the box.

The method further includes selecting a clutch set and selecting a packaging assembly. The box of the packaging assembly is opened, and the bottom sheet of foam is placed inside on the bottom. A circular piece of foam is removed from the first group of perforations in the center sheet of foam, which piece is about the same size as the diaphragm of the selected clutch set.

If the clutch set includes an unboxed bearing, a circular piece of foam is removed from the second group of perforations, which circular piece of foam has about the same diameter as the external dimension of the bearing of the selected clutch set. If the clutch set includes a boxed bearing; a rectangular piece of foam is removed from the third group of perforations, the rectangular piece of foam having about the same dimensions as the bearing box.

Next, the center sheet of foam is placed inside the box over the bottom sheet of foam. Then, the clutch cover is placed inside the box with the diaphragm positioned inside the opening formed by removal of the first circular piece of foam from the first group of perforations. If the bearing is unboxed, the bearing is placed in the circular opening formed by removal of the second circular piece of foam from the second group of perforations; if the bearing is boxed, the bearing box is placed in the rectangular opening formed by removal of the third rectangular piece of foam from the third group of perforations. The clutch disk is placed inside the cavity of the clutch cover, and the third sheet of foam is placed over the clutch disk. Finally, the top of the box is closed.

DETAILED DESCRIPTION OF THE PREFERRED EMBODIMENT

The present invention is directed to an innovation in the packaging of clutch sets. A typical clutch set includes a clutch disk, a clutch cover and a bearing. Most clutch sets also include an alignment tool. The present invention provides a packaging assembly which contains the components of a clutch set snugly in sheets of foam inside a box. The packaging assembly prevents shifting of the components during shipping and storage, regardless of the position of the box. The box is unmarked with brand indicia, but carries a label with a bar code and other descriptive information about the clutch set, particularly size.

The packaging system includes a sleeve which simply slides over the box. The sleeve has a slot in the side to expose the label on the box. Brand indicia is imprinted on the sleeve. In this way, a bearing supplier can maintain an inventory of many sizes of clutch sets in the generic boxes. Then, upon receiving an order, the supplier simply applies the pre-printed sleeves to the boxes, and the fully labeled product is ready for shipment.

Thus, it will be apparent that the present invention offers many advantages to the bearing supplier. The sturdy internal arrangement packing of the clutch set components allow the boxes to be stored or shipped in any position without risk of warping or other damage due to shifting of the parts. Because the box is free of customer specific indicia, a large inventory of prepackaged product can be maintained along with a supply of pre-printed customer-specific sleeves. This system greatly reduces the time necessary to prepare an order for shipment. These and other advantages will be apparent from the following description of a preferred embodiment of the present invention.

Figure 1:
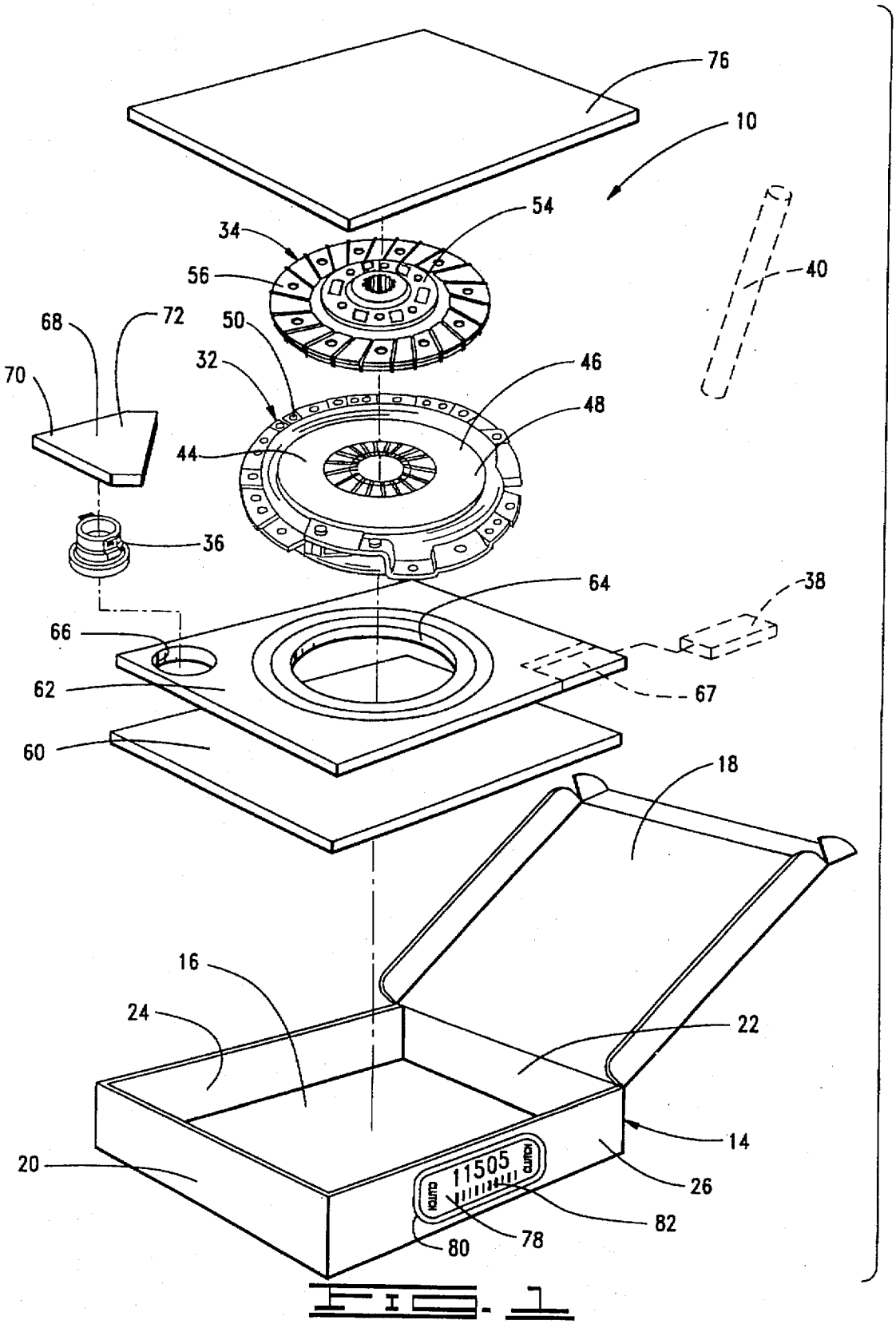
FIG. 1 is an exploded, perspective view of the packing components of the clutch set packaging system of the present invention.
Figure 2:
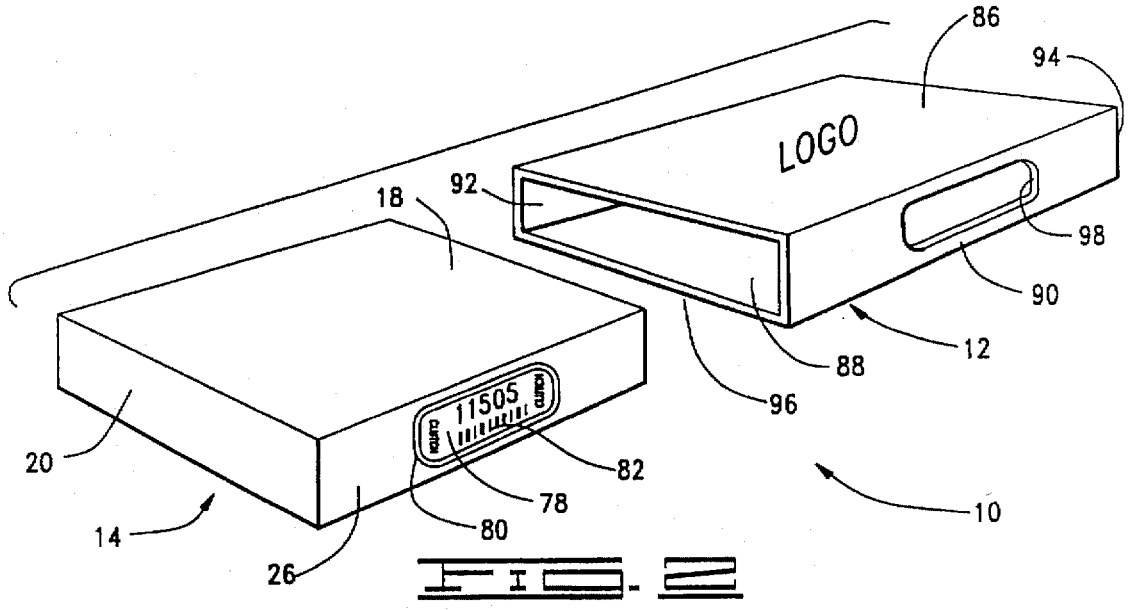
FIG. 2 is an exploded perspective view of the box and sleeve of the packaging system of the present invention.

Turning now to the drawings in general and to FIGS. 1 and 2 in particular, there is shown therein designated by the reference numeral 10 a packaging assembly made in accordance with the present invention. The assembly 10 generally comprises a brand imprinted sleeve 12 and a box 14 for containing the clutch set and which is slidably receivable in the sleeve 12.

The box 14 comprises a bottom 16, a top 18, and four sides including a front 20, a back 22 a left side 24 and a right side 26. As illustrated in FIGS. 1 and 2, the top 18 of the box 14 is hingedly attached in a known manner to open and close the box and thereby permit access to the inside of the box.

The box is adapted to contain the components of the clutch set. As shown in FIGS. 1 and 2, the typical clutch set includes a clutch cover 32, a clutch disk 34 and a clutch release bearing. The bearing may be unboxed 36 or boxed 38. Although in the drawings the clutch set is shown as including both a unboxed bearing 36 and a boxed bearing 38, this is for illustrative purposes only. Most commonly, a clutch set will have only one or the other, but not both. In some instances, the clutch set further comprises a clutch alignment tool 40.

As is apparent from the drawings, the clutch cover 32 has a bowl shaped body portion 44 with a diaphragm 46 at the base thereof and side walls 48 extending upwardly and outwardly therefrom to form a cavity. The upper edge of the side walls 48 forms a peripheral edge 50.

The clutch disk 34, of course, is disk shaped having a body 54 and an edge 56. The diameter of the clutch disk 34 usually is significantly less than the diameter of the clutch cover 32.

The assembly 10 is provided with a plurality of foam sheets for securely packing the components of the clutch set in the box 14. As used herein, "foam" refers to a compressible, pliable and relatively lightweight material. The plurality of foam sheets includes a first or bottom sheet of foam 60 sized to fit in the bottom of the box 14. The bottom sheet of foam 60 preferably is a solid, thin sheet which conforms to the dimensions of the box 14.

The plurality of foam sheets of the assembly 10 further includes a second or center sheet of foam 62 which is sized to fit in the box 14 over the bottom sheet of foam 60. This center sheet of foam 62 is provided with a central opening 64 sized to receive the diaphragm 46 of the clutch cover 32 in a manner to be described in more detail hereafter. The center sheet of foam 62 also has a corner opening for receiving the bearing: where the clutch set includes an unboxed bearing 36, the corner opening 66 is circular to receive the generally cylindrical bearing; where the clutch set includes a boxed bearing 38, the corner opening 67 is rectangular to receive the boxed bearing 38.

A third or corner sheet of foam 68 is included for covering the unboxed bearing 36 (or the boxed bearing 38). This corner sheet of foam 68 may be much smaller than the bottom and center sheets of foam 60 and 62, as it is intended to cover only the bearing 36 (or 38). Thus, the corner sheet of foam 68 is sized to have a portion which covers the bearing 36 (or 38) when the bearing is in the corner opening 66 (or 67). In the preferred embodiment, the corner sheet of foam 68 is shaped to conform to the corner of the box 14 nearest the corner opening 66 or 67. To this end, the corner sheet of foam 68 may be a polyhedron having at least one right angle, which will fit in the corner of the box 14. Even more preferably, the corner sheet of foam 68 is a wedged shaped piece with a pointed end 70, forming the right angle, and an opposing edge forming a flap 72 for a purpose yet to be described.

The assembly 10 further comprises a fourth or top sheet of foam 76 sized to fit in the box 14 over the bottom, center and corner sheets of foam 60, 62 and 68, and the clutch cover 32, the clutch disk 34 and the bearing 36 (or 38), when frilly assembled as elsewhere explained. The top sheet of foam preferably is identical to the bottom sheet of foam 60 and has the same length, width and thickness as the center sheet of foam 62.

Having described the clutch set components and various sheets of foam used for packing the clutch set components, the assembly of the package now will be described. With continuing reference to FIG. 1, the bottom sheet 60 and the center sheet 62 are positioned on the bottom 16 of the box 14. The bearing 36 is placed in the circular corner opening 66 (or the boxed bearing 38 is placed in the rectangular corner opening 67). Thus, the position of the bearing 36 (or 38) is secured by the surrounding foam sheet 62.

Figure 3:
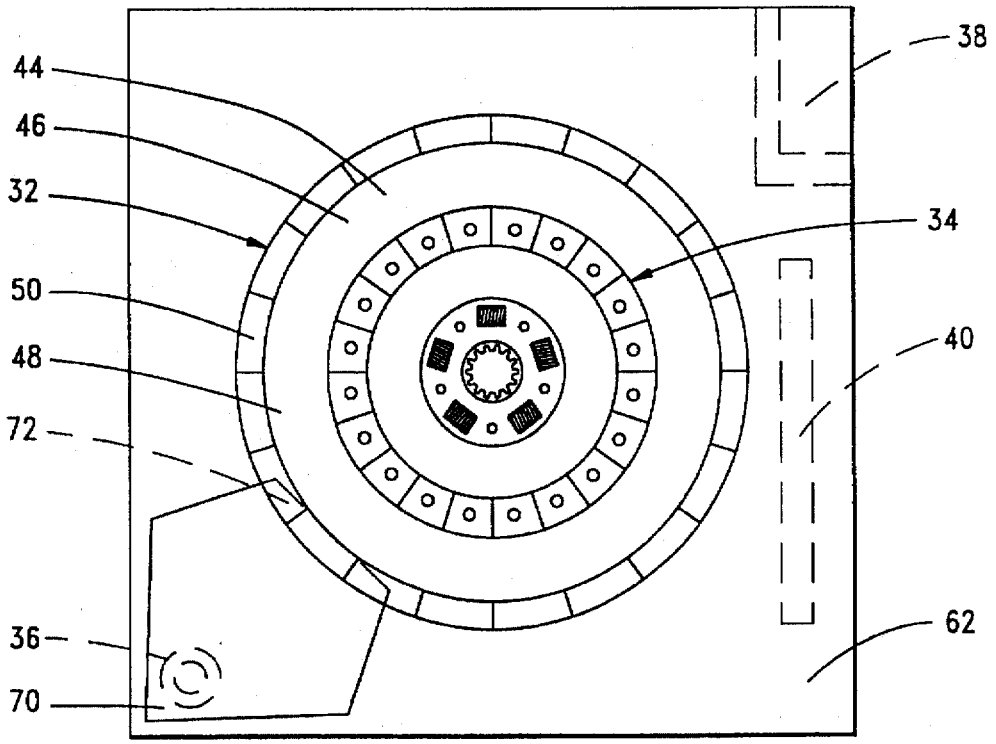
FIG. 3 is a plan view of the perforated center sheet of foam of the packing components shown in FIG. 1.
Figure 4:
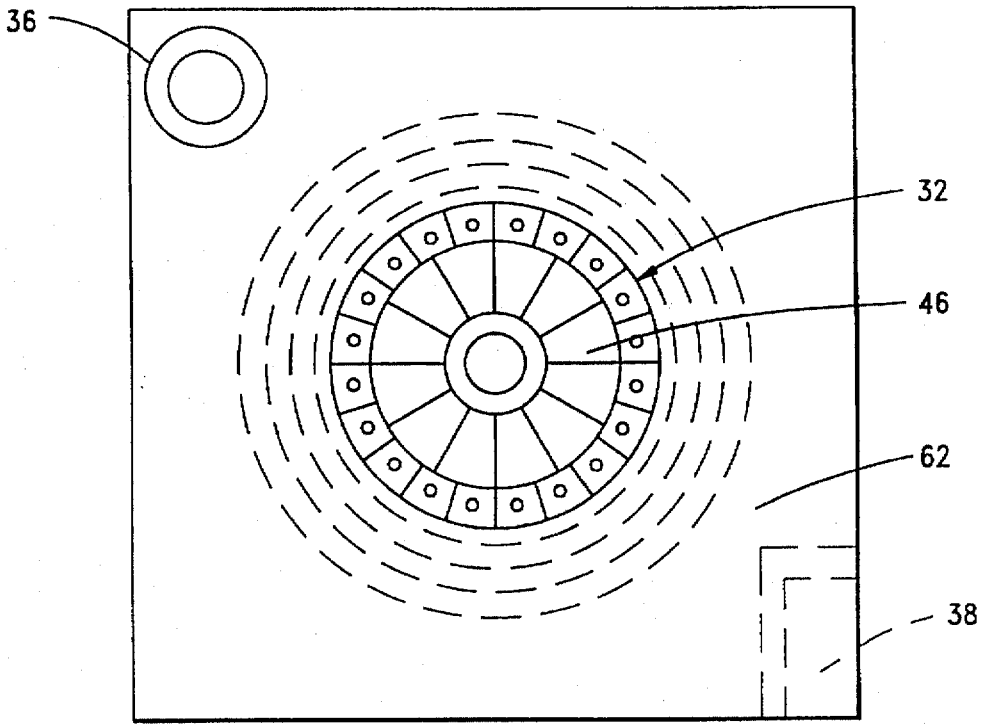
FIG. 4 is a bottom view of the perforated center sheet of foam of the packing components shown in FIG. 1, illustrating the position of the diaphragm of the clutch cover and bearing received in the openings in the foam sheet.

The clutch cover 32 is placed in the box 14 over the center sheet of foam. As shown best in FIG. 3 and 4, the diaphragm 46 of the clutch cover 32 is positioned in the center circular opening 64. Thus, lateral movement of the clutch cover 32 is impeded by the center sheet of foam 62. If an alignment tool 40 is included, the tool is placed along one side of the clutch cover 32.

Next, the corner piece of foam 68 is placed over the bearing 36 (or 38). Then, the clutch disk 34 is placed in the box 14 inside the cavity formed by the body portion 44 of the clutch cover 32. Although not shown in the drawings, the clutch disk 34 usually will be wrapped in a protective wrapper. The flap 72 of the corner sheet of foam 68 is tucked under the edge 56 of the clutch disk 34. Thus, the bearing 36 (or 38) is further secured, and the clutch disk 34 is safely nestled inside the clutch cover 32.

Having assembled the package as described, the top sheet of foam 76 is placed over the assembled clutch set and the top 18 of the box 14 is closed. Now it will be understood that the foam sheets provide several advantages. First, the compressible nature of the foam provides cushioning to the clutch set and aids in impact resistance during shipping and handling. Further, the surface of the foam provides some frictional resistance to the lateral movement of the parts inside the box.

Having completed the assembly of the clutch set in the box 14, a label 78 preferably is applied to the on side of the box, such as the side 26. Preferably, the label 78 is imprinted with indicia generically identifying the contents of the box 14. For example, the indicia on the label 78 preferably includes a bar code 82, with corresponding numbers, and other descriptive information about the clutch set, represented in the drawings simply by the word "clutch."

Preferably, the side 26 of the box 14 is imprinted with a marking 80 to show the correct position of the label 78 for a purpose yet to be described. In this way, correct positioning of the label is assured.

Returning now to FIG. 2, the box 14 preferably is made of conventional cardboard construction and is free of brand indicia. In fact, in most instances the box 14 will be unmarked except for the label 78.

Brand indicia and other trade dress may be conveniently applied to the box 14 by means of the sleeve 12 which is pre-printed. As shown in FIG. 2, the sleeve 12 is five sided, that is, it has a top 86 and bottom 88, a left side 90 and a right side 92. One end 94 is closed, and the other end 96 is open to receive the box 14. The indicia comprising the trade dress is presented simply by the word "logo" on the top 86 of the sleeve 12. It will be understood that all surfaces of the sleeve 12 can be imprinted with trade dress indicia, as desired.

The left side 90 of the sleeve 12 is provided with a opening 98 sized and positioned to expose the label 78 on the box 14 when the box is inside the sleeve. This provides a quality control feature. As most inventory management procedures will require scanning the bar code of a box before it is removed from an inventory storage site, this arrangement prevents removal of a box without the label showing through the opening.

The packaging assembly 10 of the present invention is easily adapted for use with several different sizes of clutch sets. That is, the present invention provides a packaging assembly wherein one size box is adapted to receive several different sizes of clutch sets. The same assembly can be used with sets having boxed or unboxed bearings. This greatly simplifies the packing process.

In accordance with the present invention, the packaging assembly comprises a plurality of boxes, such as the box 14 described previously. The size of the box 14 is selected to receive the largest of the plurality of clutch sets. The packaging assembly further comprises a plurality of bottom sheets of foam 60, a plurality of center sheets of foam 62, a plurality of corner sheets of foam 68, and a plurality of top sheets of foam 76.

Figure 5:
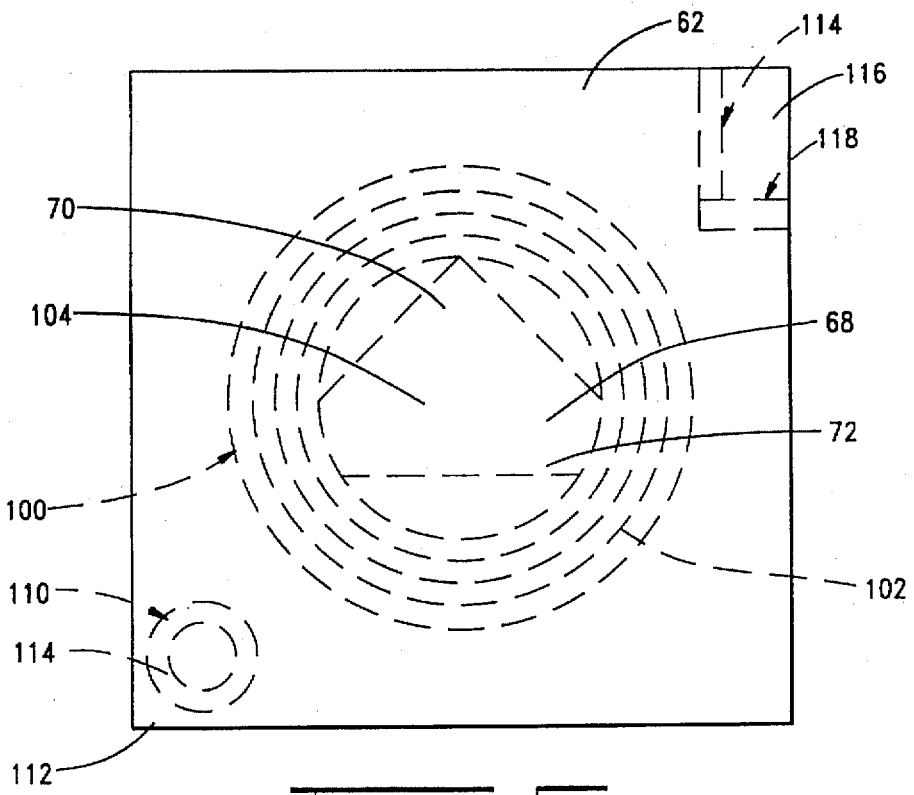
FIG. 5 is plan view of the clutch set positioned in the center foam sheet illustrating placement of the clutch disk over the clutch cover with the corner piece of foam positioned over the bearing.

As seen in FIG. 1, and referring now also to FIG. 5, each center sheet of foam 62 is perforated in a selected pattern. The perforations are designed to permit easy removal of various pieces of foam. The selected pattern of perforations includes a first group of perforations 100 which define a plurality of concentric circles generally in the center of the sheet. Each of the circles has a diameter about the same as the diameter of the diaphragm of the clutch cover in a different one of the plurality of clutch sets.

The first group of perforations 100 includes a polyhedron 104 inside the innermost one of the concentric circles 102. The polyhedron 104 is intended to be used as the corner sheet of foam 68, as previously described. To that end, the polyhedron 104 has at least one right angle forming the point 70 sized to fit in the corner of the box 14 and an extension forming the flap 72. In this way, once the selected circle of foam 102 is removed, the polyhedron 104 can be removed to serve as the corner sheet 68.

The selected pattern of perforations includes a second group of perforations 110 positioned generally in a first corner 112 of the sheet 62. The second group of perforations 110 defines a plurality of concentric circles, each of which has a diameter about the same as the diameter of one of the plurality of unboxed bearings 36.

The selected pattern of perforations includes a third group of perforations 114 in the second corner 116 of the sheet 62. The third group of perforations 114 define a plurality of concurrent rectangles 118. Each of the rectangles 118 is sized to receive a different size of boxed bearing 38. As illustrated, the rectangles 118 are concurrent that is, the perforations define rectangles having at least some common area. Preferably, the rectangles 118 share two common sides which are formed by the second corner 116 of the sheet 62.

The packaging assembly would further include a plurality of labels, such as the label 78, each with appropriate size and bar code indicia thereon corresponding to the plurality of clutch sets. The labels 78 are provided with adhesive or some other suitable means for affixing the labels to the sides of the boxes 14.

The packaging assembly further includes a plurality of sleeves, such as the sleeve 12, each with appropriate but different brand name and trade dress information, as previously described. As each of the sleeves 12 is similarly sized, as each of the boxes 14, any of the boxes 14 will fit in any of the sleeves 12.

In accordance with the method of the present invention, there is provided a plurality of clutch sets including clutch sets of different sizes. A plurality of the above-described packaging assemblies also are provided. Upon receipt of a purchase order, or other initiating event, an appropriate clutch set is selected. Then, an appropriate packaging assembly is selected. It will be understood that the packaging assemblies may include packaging assemblies of different sizes, depending on the range of sizes represented by the clutch sets.

Having selected the packaging assembly and the clutch set, the box 14 is opened and the bottom sheet of foam 60 is placed on the bottom of the box. Then, depending on the size of the diaphragm 46 of the clutch cover 32, one of the plurality of circles 102 is removed from the first group of perforations 100 in the center sheet of foam 62.

If the selected clutch set includes an unboxed bearing 36, the appropriate one of the circles 102 from the second group of perforations 110 is removed from the first corner 112 of the sheet 62. Or, if the selected clutch set includes a boxed bearing 38, then the appropriate rectangle 118 is removed from the third group of perforations 114 in the second corner 116 of the sheet 62. The "customized" center sheet 62 then is placed in the box 14 over the bottom sheet 60.

Having positioned the center sheet 62 in the box 14, the clutch cover 32 is placed in the box 14 with the diaphragm 46 positioned inside the opening formed by removal of the circle 102. Next, the bearing 36 (or 38) is positioned in the opening in the corner 112 (or 116). The clutch disk 34 is placed inside the cover 32, and the corner sheet of foam 68 is positioned over the bearing 36 (or 38) so that the point 70 fits in the corner 112 (or 116). The flap 72 is tucked under the edge 56 of the disk 34.

If the selected clutch set includes an alignment tool 40, then the tool is placed along side the clutch cover 32. The top sheet of foam 76 is placed over all, and the top 18 is closed.

A label 78 bearing the correct descriptive information is affixed to the side 26 of the box 14 inside the marking 80. Then the desired pre-printed sleeve 12 is selected, and the box is inserted into the sleeve so that the label 78 is visible through the opening 98 on the side 90 of the sleeve.

Now it will be understood that the packaging system and method of the present invention has many advantages. The clutch sets may be pre-boxed and in generic boxes, and an inventory of pre-printed sleeves is maintained. In addition to the convenience and versatility offered by this system, the time required to process customer orders is greatly reduced. This is because the only processing required is to insert the pre-boxed clutch sets into the pre-printed sleeves. Moreover, this system is less costly as the application of trade dress indicia to the thin cardboard sheets of which the sleeves are made is much less expensive than would be the application of similar indicia directly to the boxes.

Changes may be made in the combination and arrangement of the various parts, elements, steps and procedures described herein without departing from the spirit and scope of the invention as defined in the following claims.

What is claimed is:

1. An assembly comprising:

a clutch cover having a diaphragm, a body portion extending upwardly and outwardly from the diaphragm to form a cavity, and a peripheral edge around the body portion;

a clutch disk having an edge;

a clutch bearing;

a box sized to receive the clutch cover, the clutch disk and the bearing, wherein the box has a bottom, a top and four sides, and wherein the top of the box is openable to permit access to the inside of the box;

a bottom sheet of foam sized to fit in the bottom of the box;

a center sheet of foam sized to fit in the box over the bottom sheet of foam, wherein the center sheet of foam has a central opening sized to receive the diaphragm of the clutch cover, wherein the diaphragm of the clutch cover is positioned therein, wherein the center sheet of foam has a corner opening sized to receive the bearing, and wherein the bearing is positioned therein;

a corner sheet of foam sized to have a portion which covers the bearing in the corner opening of the center sheet of foam and to have a flap sized to fit under the edge of the clutch disk, whereby the position of the bearing in the corner opening is at least partially secured by the corner sheet of foam while it is held in place by the edge of the clutch disk;

wherein the clutch disk is positioned to nest inside the body portion of the clutch cover; and a top sheet of foam sized to fit in the box over the bottom, center and corner sheets of foam and the clutch cover, clutch bearing and clutch disk assembled in the box.

2. The assembly of claim 1 further comprising a clutch alignment tool positioned over the center sheet of foam and under the top sheet of foam.

3. The assembly of claim 1 wherein the portion of the corner sheet of foam which covers the bearing is shaped to conform to the corner of the box nearest the bearing.

4. The assembly of claim 1 wherein the bearing is unboxed and the corner opening is sized to receive the bearing.

5. The assembly of claim 4 wherein the corner opening is sized to receive the end of the bearing.

6. The assembly of claim 1 wherein the bearing is boxed and the corner opening is sized to receive the box containing the bearing.

7. The assembly of claim 1 wherein a label having indicia thereon is affixed to one of the four sides of the box and wherein the assembly further comprises a sleeve having a top, a bottom, two sides, a closed end and an open end, wherein the sleeve is sized to receive the box, and wherein one of the sides of the sleeve has an opening therein sized to expose the label on the box when the box is received in the sleeve.

8. The assembly of claim 7 wherein the box is unmarked with brand indicia, and wherein the sleeve is marked with brand indicia.

9. The assembly of claim 8 wherein the indicia on the label includes a bar code and size information of the clutch set.

10. The assembly of claim 1 further comprising a clutch alignment tool positioned over the center sheet of foam and under the top sheet of foam, wherein the bearing is unboxed and the corner opening is sized to receive the bearing, wherein a label with indicia thereon is affixed to one of the four sides of the box, wherein the assembly further comprises a sleeve having a top, a bottom, two sides, a closed end and an open end, wherein the sleeve is sized to receive the box, and wherein one of the sides of the sleeve has an opening therein sized to expose the label on the box when the box is received in the sleeve.

11. The assembly of claim 1 further comprising a clutch alignment tool positioned over the center sheet of foam and under the top sheet of foam, wherein the bearing is boxed and the corner opening is sized to receive the box containing the bearing, wherein a label with indicia thereon is affixed to one of the four sides of the box, wherein the assembly further comprises a sleeve having a top, a bottom, two sides, a closed end and an open end, the sleeve being sized to receive the box, and wherein one of the sides of the sleeve has an opening therein sized to expose the label on the box when the box is received in the sleeve.

12. A packaging assembly for packaging clutch sets, wherein each of the clutch sets comprises a clutch disk having an edge, a clutch bearing and a clutch cover, the clutch cover having a diaphragm, a body portion extending upwardly and outwardly from the diaphragm to form a cavity, wherein the packaging assembly is adapted to package clutch sets of a plurality of sizes, and wherein the packaging assembly is adapted to receive both boxed and unboxed bearings, the assembly comprising:

a plurality of boxes all of the same size, the size being selected to receive the largest of the plurality of clutch sets, each of the boxes having a bottom, a top and four sides, the top of each box being openable to permit access to the inside of the box;

a plurality of top sheets of foam, each top sheet of foam sized to fit in the bottom of each of the boxes;

a plurality of center sheets of foam, each center sheet of foam sized to fit in each of the boxes over the bottom sheets of foam, wherein each of the center sheets of foam is perforated in a selected pattern for easy removal of a first, second and third piece of foam, wherein the selected pattern includes a first group of perforations defining a plurality of concentric circles generally in the center of the center sheet of foam, each of the circles of the first group having a diameter about the same as the diameter of the diaphragm of the clutch cover in a different one of the plurality of clutch sets, wherein the selected pattern of perforations includes a second group positioned generally in a first corner of the second sheet of foam, the second group defining a plurality of concentric circles, each of the circles of the second group of perforations having a diameter about the same as the external dimension of one of the plurality of unboxed bearings of the clutch sets, wherein the selected pattern of perforations includes a third group of perforations positioned generally in a second corner of the center sheet of foam, the second group defining a plurality of concurrent rectangles, each rectangle sized to receive a different one of the plurality of boxed bearings; and a plurality of top sheets of foam sized to fit in each of the boxes over the first, corner and center sheets of foam, when assembled with the clutch set inside the box.

13. The assembly of claim 12 wherein the bottom sheets of foam and the top sheets of foam are similarly shaped.

14. The assembly of claim 12 wherein the concurrent rectangles defined by the third group of perforations have two common sides formed by the corner of the center sheet of foam.

15. The assembly of claim 12 wherein the third group of perforations in the selected pattern of perforations includes a polyhedron inside the innermost one of the concentric circles in the first group, the polyhedron having at least one right angle and being sized to fit in the first corner of the box over an unboxed bearing or over a boxed bearing in the second corner of the box.

16. The assembly of claim 12 further comprising a plurality of labels, each label having indicia imprinted thereon, the indicia including size information about one of the plurality of clutch sets, wherein each of the labels is affixable to one of the four sides of one of the plurality of boxes, wherein the assembly further comprises a plurality of sleeves, each sleeve having a top, a bottom, two sides, a closed end and an open end, each sleeve being sized to receive one of the plurality of boxes, and wherein one of the sides of each of the sleeves has an opening therein sized to expose a label on the box when one of the plurality of boxes, with a label affixed thereon, is received in the sleeve.

17. The assembly of claim 16 wherein each of the plurality of boxes is unmarked with brand indicia, and wherein each of the sleeves is marked with brand indicia.

18. The assembly of claim 17 wherein the plurality of sleeves includes at least one sleeve marked with indicia of a first brand and at least one sleeve marked with indicia of a second brand.

19. The assembly of claim 17 wherein each of the labels includes a bar code.

20. The assembly of claim 19 wherein the third group of perforations in the selected pattern of perforations in the center sheets of foams includes a polyhedron inside the innermost one of the concentric circles in the first group, the polyhedron having at least one right angle and being sized to fit in the first corner of the box over an unboxed bearing or over a boxed bearing in the second corner of the box.

21. A method for packaging a plurality of clutch sets of different sizes, the method comprising:

providing a plurality of clutch sets including clutch sets of different sizes, each clutch set comprising:

a clutch disk having an edge;

a clutch bearing; and a clutch cover having a diaphragm, a body portion extending upwardly and outwardly from the diaphragm to form a cavity;

wherein some of the clutch sets include boxed bearings and some of the clutch sets include unboxed bearings;

providing a plurality of packaging assemblies, each packaging assembly comprising:

a plurality of boxes all of the same size, the size being selected to receive the largest of the plurality of clutch sets, each of the boxes having a bottom, a top and four sides, the top of each box being openable to permit access to the inside of the box;

a plurality of bottom sheets of foam, each bottom sheet of foam sized to fit in the bottom of each of the boxes;

a plurality of center sheets of foam, each center sheet of foam sized to fit in each of the boxes over the bottom sheets of foam, wherein each of the center sheets of foam is perforated in a selected pattern for easy removal of a first, second and third piece of foam, wherein the selected pattern includes a first group of perforations defining a plurality of concentric circles generally in the center of the center sheet of foam, each of the circles of the first group having a diameter about the same as the diameter of the diaphragm of the clutch cover in a different one of the plurality of clutch sets, wherein the selected pattern of perforations includes a second group positioned generally in a first corner of the center sheet of foam, the second group defining a plurality of concentric circles, each of the circles of the second group of perforations having a diameter about the same as the external dimension of one of the plurality of unboxed bearings of the clutch sets, wherein the selected pattern of perforations includes a third group of perforations positioned generally in a second corner of the center sheet of foam, the third group defining a plurality of concurrent rectangles, each rectangle sized to receive a different one of the plurality of boxed bearings; and a plurality of top sheets of foam sized to fit in each of the boxes over the bottom and center sheets of foam, when assembled with the clutch set inside the box;

selecting a clutch set;

selecting a packaging assembly;

opening the box of the packaging assembly;

placing the bottom sheet of foam on the bottom of the inside of the box;

removing from the first group of perforations in the center sheet of foam a circle of foam which is about the same size as the diaphragm of the selected clutch set;

if the clutch set includes an unboxed bearing, removing from the second group of perforations a circle having about the same diameter as the external dimension of the bearing of the selected clutch set;

if the clutch set includes a boxed bearing, removing from the third group of perforations a rectangle having about the same dimensions as the bearing box;

placing the center sheet of foam inside the box over the first sheet of foam;

placing the clutch cover inside the box with the diaphragm positioned inside the opening formed by removal of the first circular piece of foam from the first group of perforations;

if the bearing is unboxed, placing the bearing in the circular opening formed by removal of the second circular piece of foam from the second group of perforations;

if the bearing is boxed, placing the bearing box in the rectangular opening formed by removal of the third rectangular piece of foam from the third group of perforations;

placing the clutch disk inside the cavity of the clutch cover;

placing the third sheet of foam over the clutch disk; and closing the top of the box.

22. The method of claim 21 wherein the third group of perforations in the selected pattern of perforations in the center sheet of foam in the packaging assembly includes a polyhedron inside the innermost one of the concentric circles in the first group, the polyhedron having at least one right angle and being sized to fit in the first corner of the box over an unboxed bearing or over a boxed bearing in the second corner of the box, and wherein the method further comprises:

removing the polyhedron from the center sheet;

if the bearing is unboxed, positioning the polyhedron over the bearing so that the right angle of the polyhedron fits in the first corner of the box;

if the bearing is boxed, positioning the polyhedron over the bearing box so that the right angle of the polyhedron fits in the second corner of the box; and tucking a portion of the polyhedron opposite the right angle under the edge of the clutch disk.

23. The method of claim 21 wherein the selected clutch set comprises a clutch alignment tool and wherein the method further comprises:

placing the clutch alignment tool inside the box between the center and top sheets of foam.

24. The method of claim 22 further comprising:

providing a plurality of labels, each label having indicia imprinted thereon which indicia includes size information about one of the plurality of clutch sets, wherein each of the labels is affixable to one of the four sides of one of the plurality of boxes providing a plurality of sleeves, each sleeve having a top, a bottom, two sides, a closed end and an open end, each sleeve being sized to receive one of the plurality of boxes, and wherein one of the sides of each of the sleeves has an opening therein about the same size as one of the plurality of labels;

selecting one of the plurality of labels descriptive of the selected clutch set;

affixing the selected label to the side of the box of the selected packaging assembly;

selecting one of the plurality of sleeves; and inserting the box with the label affixed thereto into the selected sleeve so that the label is visible through the opening in the side of the box.

25. The method of claim 24 wherein each of the plurality of boxes is unmarked with brand indicia, and wherein each of the sleeves is marked with brand indicia.

26. The method of claim 25 wherein the plurality of sleeves includes at least one sleeve marked with indicia of a first brand and at least one sleeve marked with indicia of a second brand.

27. The method of claim 26 wherein the indicia on each of the plurality of labels includes a bar code.

28. The method of claim 27 wherein the third group of perforations in the selected pattern of perforations in the center sheet of foam of the packaging assembly includes a polyhedron inside the innermost one of the concentric circles in the first group, the polyhedron having at least one right angle and being sized to fit in the first corner of the box over an unboxed bearing or over a boxed bearing in the second corner of the box, and wherein the method further comprises:

removing the polyhedron from the center sheet;

if the bearing is unboxed, positioning the polyhedron over the bearing so that the right angle of the polyhedron fits in the first corner of the box;

if the bearing is boxed, positioning the polyhedron over the bearing box so that the right angle of the polyhedron fits in the second corner of the box; and tucking a portion of the polyhedron opposite the right angle under the edge of the clutch disk.

* * * * *

UNITED STATES PATENT AND TRADEMARK OFFICE

CERTIFICATE OF CORRECTION

PATENT NO. : 5,685,431

DATED : November 11, 1997

INVENTOR(S) : Hyrum Chambers, Randy James Millikan and Claude Rappaport

It is certified that error appears in the above-indentified patent and that said Letters Patent is hereby corrected as shown below:

On the Title Page under FOREIGN PATENT DOCUMENTS delete "262251A" and insert --2626251A--

Column 3, line 8, after the word bearing, delete ";" and insert --,--

Column 5, line 14, delete "frilly" and insert --fully--

Column 5, line 55, delete "on" and insert --one--

Column 9, line 55, after the word the, delete "second" and insert --third--

Signed and Sealed this

Twenty-fourth Day of February, 1998

*Attest:*

*Attesting Officer*

Bruce Lehman

BRUCE LEHMAN

*Commissioner of Patents and Trademarks*